US012312819B2

(12) United States Patent
Smith

(10) Patent No.: US 12,312,819 B2
(45) Date of Patent: May 27, 2025

(54) RAISED PANEL

(71) Applicant: Gregory William Smith, Port Orchard, WA (US)

(72) Inventor: Gregory William Smith, Port Orchard, WA (US)

( * ) Notice: Subject to any disclaimer, the term of this patent is extended or adjusted under 35 U.S.C. 154(b) by 0 days.

(21) Appl. No.: 18/342,693

(22) Filed: Jun. 27, 2023

(65) Prior Publication Data

US 2023/0417068 A1 Dec. 28, 2023

Related U.S. Application Data

(60) Provisional application No. 63/356,342, filed on Jun. 28, 2022.

(51) Int. Cl.
*E04F 15/18* (2006.01)
*E04F 15/02* (2006.01)

(52) U.S. Cl.
CPC ..... *E04F 15/185* (2013.01); *E04F 15/02188* (2013.01)

(58) Field of Classification Search
CPC ..... E04F 15/02188; E04F 15/185; B65D 19/0014; B65D 19/0018; B65D 19/036; B65D 19/0032; B65D 19/003; B65D 19/004; B65D 19/0083; B65D 19/0087
See application file for complete search history.

(56) References Cited

U.S. PATENT DOCUMENTS

| | | | | |
|---|---|---|---|---|
| 3,424,110 | A * | 1/1969 | Toot | B65D 19/004 108/901 |
| 3,699,901 | A * | 10/1972 | Cook, III | B65D 19/004 108/57.25 |
| 4,085,557 | A | 4/1978 | Tharp | |
| 4,254,873 | A * | 3/1981 | Cook, III | B65D 19/00 108/55.3 |
| 6,029,583 | A * | 2/2000 | LeTrudet | B65D 19/0012 108/57.25 |
| D554,825 | S * | 11/2007 | Lux, Jr. | D34/38 |
| 7,698,859 | B2 | 4/2010 | Marti | |
| 9,051,739 | B2 | 6/2015 | Rosan | |
| 9,919,835 | B2 | 3/2018 | Brisendine et al. | |
| 11,760,537 | B1 * | 9/2023 | Cosentino | B65D 19/08 206/600 |
| 2005/0016097 | A1 | 1/2005 | Janesky | |
| 2006/0048687 | A1 * | 3/2006 | Quigley | B65D 19/004 108/57.28 |
| 2008/0127593 | A1 | 6/2008 | Janesky | |
| 2009/0120823 | A1 | 5/2009 | Seagle | |
| 2023/0012225 | A1 | 1/2023 | Fearon | |

FOREIGN PATENT DOCUMENTS

DE 9317024 U1 * 5/1994

* cited by examiner

*Primary Examiner* — Christine T Cajilig
(74) *Attorney, Agent, or Firm* — Law Office of Leopold Lueddemamm; Leopold Lueddemann

(57) ABSTRACT

A raised panel for the purpose of protecting stored items from moisture damage and promoting air circulation for use in storage units is disclosed.

9 Claims, 5 Drawing Sheets

RAISED PANEL

FIELD OF THE INVENTION

The present invention is related to temporary flooring, specifically temporary and reusable flooring that keeps items away from moisture and extreme temperatures and promotes air circulation.

CROSS REFERENCE TO RELATED APPLICATIONS

This application claims the benefit of U.S. Provisional Patent Application No. 63/356,342, filed Jun. 28, 2022, entitled "A raised panel for the purpose of protecting stored items from water damage due to seepage", the disclosure of which is incorporated by reference herein in its entirety.

BACKGROUND OF THE INVENTION

Storage areas such as basements or storage facilities that contain a plurality of what are commonly referred to as "storage units" generally have cement floors and often cement (or cement brick) walls as well. Moisture can seep through the cement, accumulate through condensation or leakage, and cause moisture damage, and even mold and rot, to the stored items. In addition, most storage facilities (including self-storage facilities) have a lot of roof square footage that can easily be ignored by owners and managers of these facilities. Metal roofs, which are common in self-storage, were not intended to be waterproof, as they are designed for water flow, but sometimes ponding or standing water can occur, leading to leaks into the storage units. Other causes of leaks in metal roofs include rust, holes due to crimping or creasing, movement, corrosion, punctures, fastener issues, and other causes of leaks. Non-metal roofs of storage units have leaks as well. Additionally, moisture damage, including mildew and rot, to the stored items is frequently exacerbated because leaks and moisture accumulation in storage units may remain undetected for extended periods because the units sometimes are not visited for weeks or months at a time. Therefore, moisture can enter structures through the floor, the walls and even from above through the roof and/or ceiling and cause damage to the stored items.

Strategies to protect items stored inside from damage due to unwanted moisture in structures is not a new idea. One solution involves basement subfloors, which tend to be permanent structures. Basement subfloors have been used for centuries. Accordingly, many patents have been filed regarding basement sub-floors, most of which consist mainly of improvements in the material used for these inventions over the traditional wood structures (usually lumber 2×4 s). As a result, the recent patents in this area focus not on the structure and material, but rather the means to join the units, often tiles, that comprise the subflooring. For example, US2008/0127593 explains an invention in an attempt to prevent moisture from climbing up the joints of the subflooring tiles by incorporating a "lap joint" where each subfloor tile connects to another subfloor tile. Patent application 2007/0011980 explains another invention that allows the assembly of the subflooring tiles to only be lined up on one side/one direction, thereby simplifying the subfloor assembly process. A great deal of effort is used to make these joints water-tight to prevent moisture from reaching the top portion of a subfloor, which is understandable, especially if carpet or wood flooring is installed over the subfloor. For this reason, most subflooring has a planar surface.

However, if somehow moisture does wick up through a tile for any number of reasons (tiles are not connected correctly, a tile breaks or is defective), or moisture is introduced from above or from the side of the flooring tile, the prevention of moisture traveling upwards also serves as a moisture barrier from moisture traveling away from the items placed on top of the subfloor. Again, most subflooring is planar on the top surface. This can easily lead to ponding of moisture, resulting in marinating the stored items in moisture. A few examples of subflooring do not have a top planar surface, but these either contain repeating isolated depressions on the surface or depressions with drainage holes extending to the construction floor. For example, a "dimple board" has depressions in the surface where the plastic is formed out of a sheet and the isolated top depressions are the legs that protrude from the bottom of the sheet. But these depressions also serve as independent and isolated cups that, once full of moisture, become a liquid retaining device, effectively ensuring the stored items remain in contact with the now retained liquid, and thereby almost ensuring moisture damage to the stored items. A few devices provide drainage holes in a surface depression because moisture is retained in these types of depressions (usually traction structures), but this again allows for moisture to travel upwardly to the items on the surface of the subfloor and, again, provides for a receptacle for moisture to remain close or in direct contact with the stored items, likely again ensuring moisture damage. Additionally, these drainage holes prevent the ability of a subfloor to provide a thermal break between the structural flooring and the items on the top of the subflooring. Finally, diamond plate and other non-slip designs on the top portion of a subfloor are not designed for air flow and generally do not therefor provide for airflow or liquid drainage and, once again, may therefore also serve to allow ponding underneath and around stored items.

The subflooring discussed above is generally costly because it is intended as a permanent subflooring solution for residential and commercial basements. Subflooring costs at least several dollars a square foot and also typically involves the labor costs for installation. This expense is not economically efficient for use in self-storage units or other storage facilities. For example, permanent subflooring installed in the most common 10'×10' storage unit can easily cost several hundred dollars in materials, as well as installation costs and removal costs to prevent ameliorative waste/loss of deposit.

In light of these expenses, it is understandable why many people do not use anything to protect their stored items from moisture damage in storage facilities. As a result, a quick search on the internet provides a plethora of articles on who is responsible for moisture damage to stored items in self-storage units, how to file insurance claims, and how much insurance does (and does not) pay for moisture damage, implicating moisture damage to stored items is a real problem for many. Further, if any strategies are used to protect against moisture damage in storage units, the items used invariably consist of pallets, tarps, plastic sheeting, kitty litter (the reason behind using kitty litter is to absorb moisture from the air, which is generally not effective), or a combination thereof placed on the floor in storage facilities. Moisture can accumulate on tarps and plastic sheeting, thereby again resulting in likely ponding for items to marinate in the moisture, causing damage to the items. Wooden pallets can wick up moisture, rot and break down, allowing moisture damage, or sometimes even directly cause damage to the stored items. For example, the metal fasteners used to assemble wooden pallets can oxidize and rust, also causing damage to the stored items. Plastic pallets have also been used, but they do not provide even surfaces, which can make storing items on top of pallets tricky. Plastic pallets also readily allow moisture to travel upward to the stored items and are heavy, cumbersome, and expensive.

The prevention of moisture damage to stored items is clearly challenging, especially in storage facilities. An inexpensive, reusable, lightweight and effective means to prevent moisture damage to items stored in storage units is needed, as common solutions such as plastic sheeting, tarps, and pallets are ineffective and permanent subflooring is not a financially viable option in such circumstances. What is needed is an affordable and temporary subfloor design that prevents moisture from collecting both from below the subfloor as well as from the top of the subfloor, thereby preventing damage to the items resting on a subfloor.

SUMMARY OF THE INVENTION

It is therefore an object of the present invention to provide a fast, secure and convenient way for consumers to install and remove a temporary moisture barrier without the use of a contractor or handy man.

It is another object of the invention to provide a reasonably priced alternative to permanent subflooring options for use in self-storage units.

It is yet another object of the invention to provide moisture abatement from under the invention as well as from the top surface of the invention.

It is another object of the invention to provide a thermal barrier from extreme temperatures and construction flooring for the items placed in storage units.

It is yet another object of the present invention is to overcome the limitations inherent in the various inefficient common strategies of moisture abatement typically used in storage units.

It still yet another object of the present invention to provide reusable and easy-to-stack-and-store temporary flooring as an alternative to permanent subflooring or makeshift flooring options in storage facilities.

The present invention relates to inexpensive yet effective temporary, lightweight flooring in storage units to help protect stored items from moisture and thermal damage.

DETAILED DESCRIPTION OF PREFERRED EMBODIMENTS OF THE INVENTION

Figure 1:
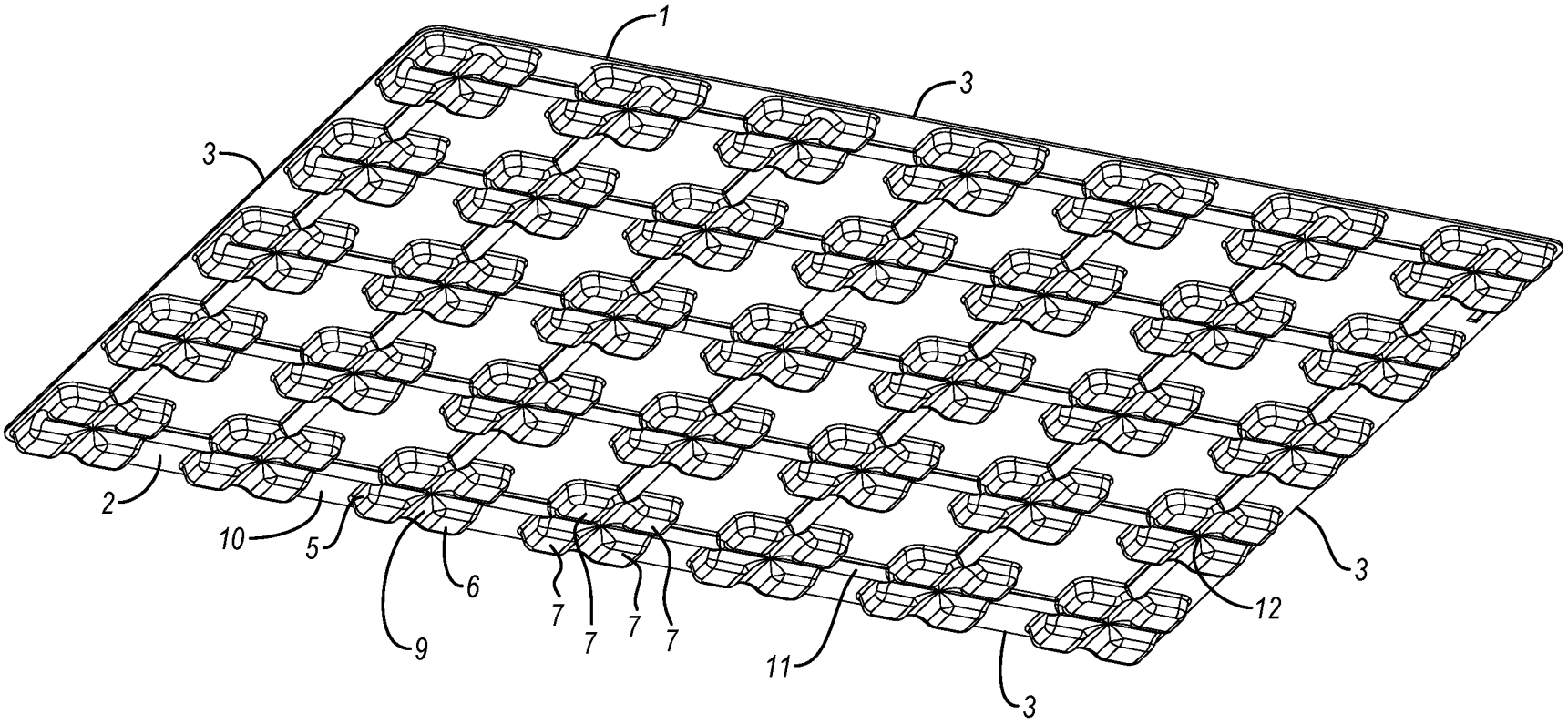
FIG. 1 is a bottom oblique angle view to illustrate the projections and coplanar drainage channels extending from one side to an opposing side and positioned in a general grid arrangement so that each drainage channel extending from one side to an opposing side perpendicularly intersects each drainage channel extending from the remaining said two opposing sides such that each depression is bisected by a perpendicular drainage channel intersection.

Now looking at FIG. 1, the raised panel for installation on a construction surface can be used individually or in combination with other adjoining raised panels to cover a floor surface is viewed at an angle from below in order to more easily see the various contours, features and functionality of the raised panel. The preferred embodiment, a generally planar and quadrilateral shape of the raised panel base, (1) is shown looking up from beneath the bottom portion. (2) The side portions can also be seen in this view. (3) The molded projections (5) extend from the bottom (2) and terminate in a coplanar lower portion edge. (6) These molded projections (5) therefore act as legs for the raised panel base (1) when the raised panel is placed with the bottom facing a construction surface, such as a cement slab in a storage unit. In the preferred embodiment, the number of projections is thirty-five but can be any number that provides for sufficient support for items placed onto the raised panel and permit moisture abatement, a thermal barrier, and air circulation. The space in between the projections (10) allows for air and moisture to circulate among the projections. (5) Specifically, this space allows the distribution of any moisture on the construction surface, below the top (4) of the raised panel and any items placed thereupon, as well as allowing the circulation of air to dry the moisture. The space in between the projections (10) also provides an air space between the construction flooring and the stored items, thereby creating a thermal barrier.

In the preferred embodiment, each projection can be seen further divided into four secondary projections (7) so that each group of secondary projections proceeding from each projection terminates in the coplanar lower portion edge, (6) comprising four equal parts per projection. Further, a raised portion (9) of the secondary projection (7) grouping reduces contact with a construction floor surface while increasing points of contact with the construction floor surface, thereby further providing moisture and air to travel among the projections (5) and secondary projections. (7) This feature also assists in the thermal barrier function of the invention by introducing more airspace between the top portion (4) of the raised panel base (1) and a construction floor.

Finally, the drainage channels (11) can be seen from the bottom (2) spanning the raised panel base (1), extending from one side (3) to an opposing side (3) in a general grid arrangement so that each drainage channel (11) perpendicularly intersects (12) another drainage channel, thereby forming the grid pattern. As can be seen in FIG. 1, in the preferred embodiment, one set of drainage channels are aligned along the X-axis and another set of drainage channels are aligned along the Y-axis. Additionally, the grid of drainage channels is positioned on the raised panel base (1) so that each intersection (12) is centered on a projection (5) thereby each drainage channel (11) bisects a row or column of projection (5) and, cumulatively, each intersection (12) is generally centered on each projection. (5) It is clear from looking at FIG. 1 that the projections (7), (and therefore the corresponding projection (5)), located at each side (3) will not have the same number of drainage channels (11) in its intersections (12), but will nonetheless be connected to the grid of drainage channels. (11)

Figure 2:
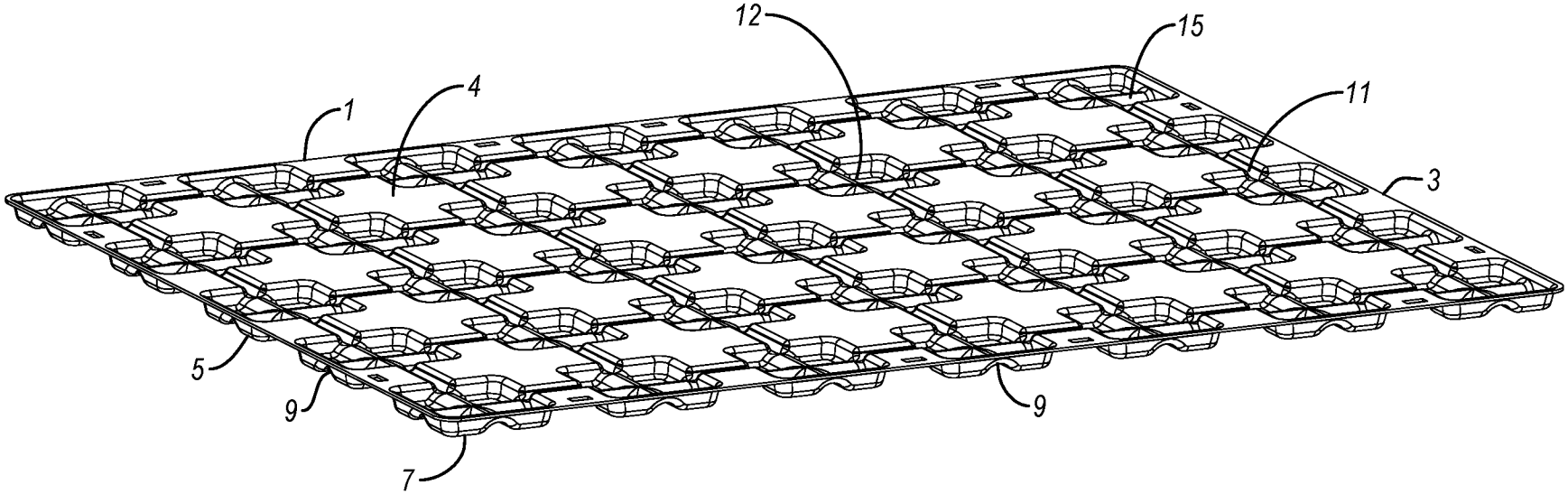
FIG. 2 is a top oblique angle view to illustrate the depressions and coplanar drainage channels.

Now looking at FIG. 2, the depressions (15) are seen from a top oblique view showing the top portion (4) drainage channels (11) connecting each depression (15) in the general grid pattern. The provision for the distribution and circulation of moisture or air can be seen among the drainage channels (11) and the depressions. (15) Looking at the secondary projections (7) and the raised portions (9), the channels created by the raised portions (9) between the secondary projections (7) can be seen. Further, the provision for the airflow and moisture circulation among the grid pattern drainage channels (11) and depressions (15) on the top (4) of the raised panel base (1) and the provision for separate air and moisture circulation among the projections (5), secondary projections, (7) and raised portions (9) through the reduction of contact with the construction floor surface is demonstrated when viewing FIG. 1 in conjunction with FIG. 2. Through this functionality of the raised panel, moisture accumulation and leaks into a storage facility that find their way to the flooring can be directed away from the bottoms of stored items, whether the moisture source is located above the stored items and the raised panel, from below the stored items and above the raised panel, as well as from moisture sources from below the raised panel and below the stored items. In other words, the invention keeps stored items above water seepage and allows for water (or other liquids) to dry if it has seeped into a storage unit.

Figure 3:
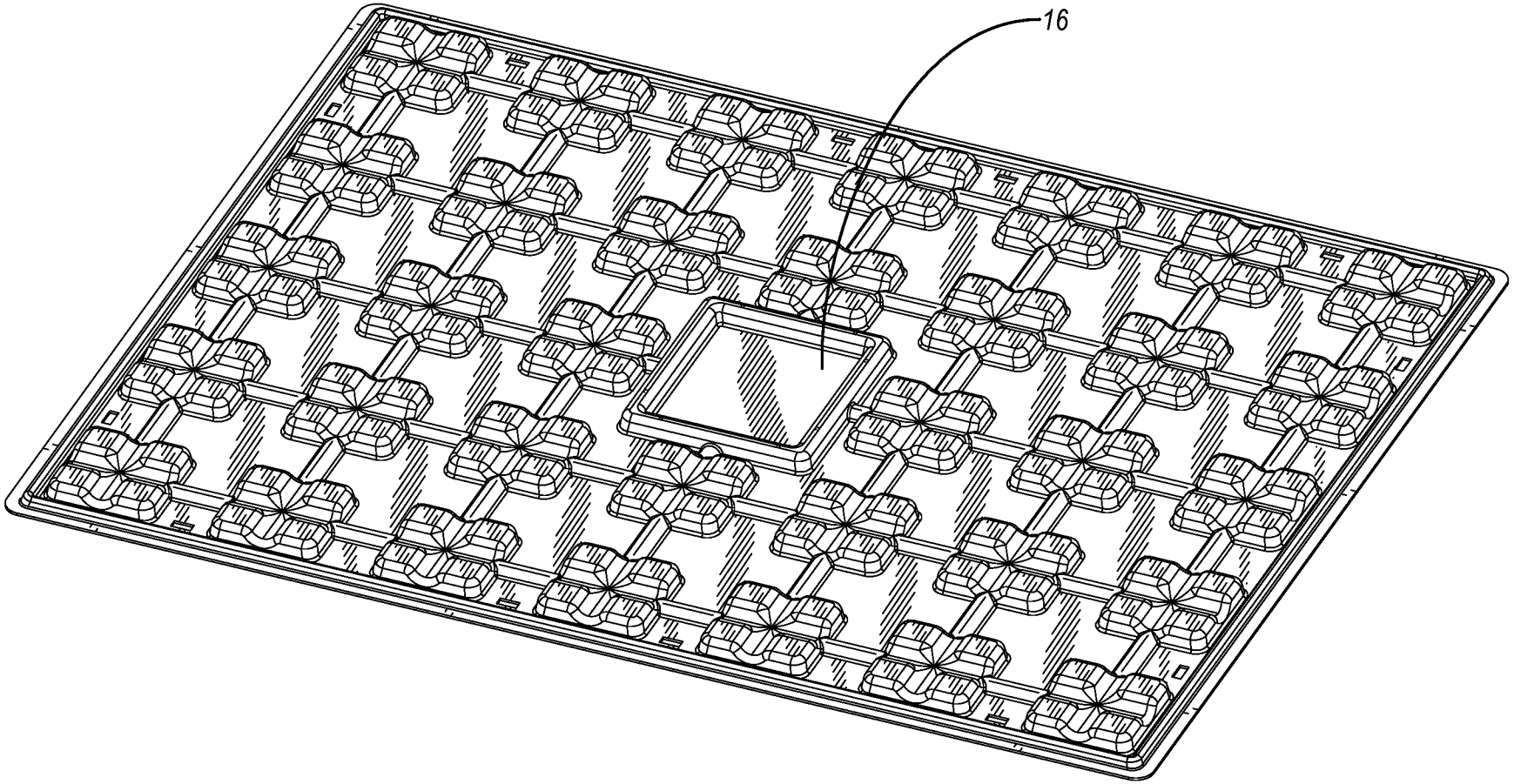
FIG. 3 is an alternative embodiment bottom oblique angle view to illustrate the projections, coplanar drainage channels and a middle portion for information.

Now looking at FIG. 3, the middle portion for information (16) in an alternative embodiment can be used for branding, custom branding, country of origin, and other information.

Figure 4:
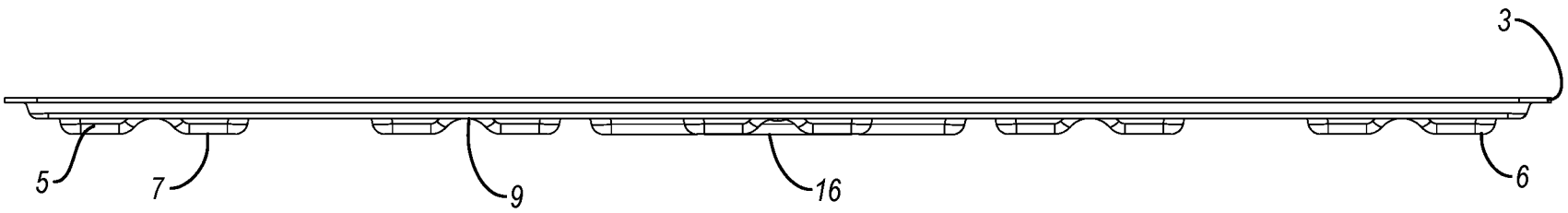
FIG. 4 is a side view of an alternative embodiment to illustrate the top portion, bottom portion, projections, and coplanar lower projection edge.

Now looking at FIG. 4, a side view of an alternative embodiment shown in FIG. 3 illustrates the side (3) and projections (5) and secondary projections (7) with their coplanar lower portion edge. (6) Additionally, the raised portions (9) of the secondary projections (7) can also be viewed, further providing for increased airflow and moisture distribution for abatement and drying. The middle portion for information (16) can be viewed from this perspective as well.

Figure 5:
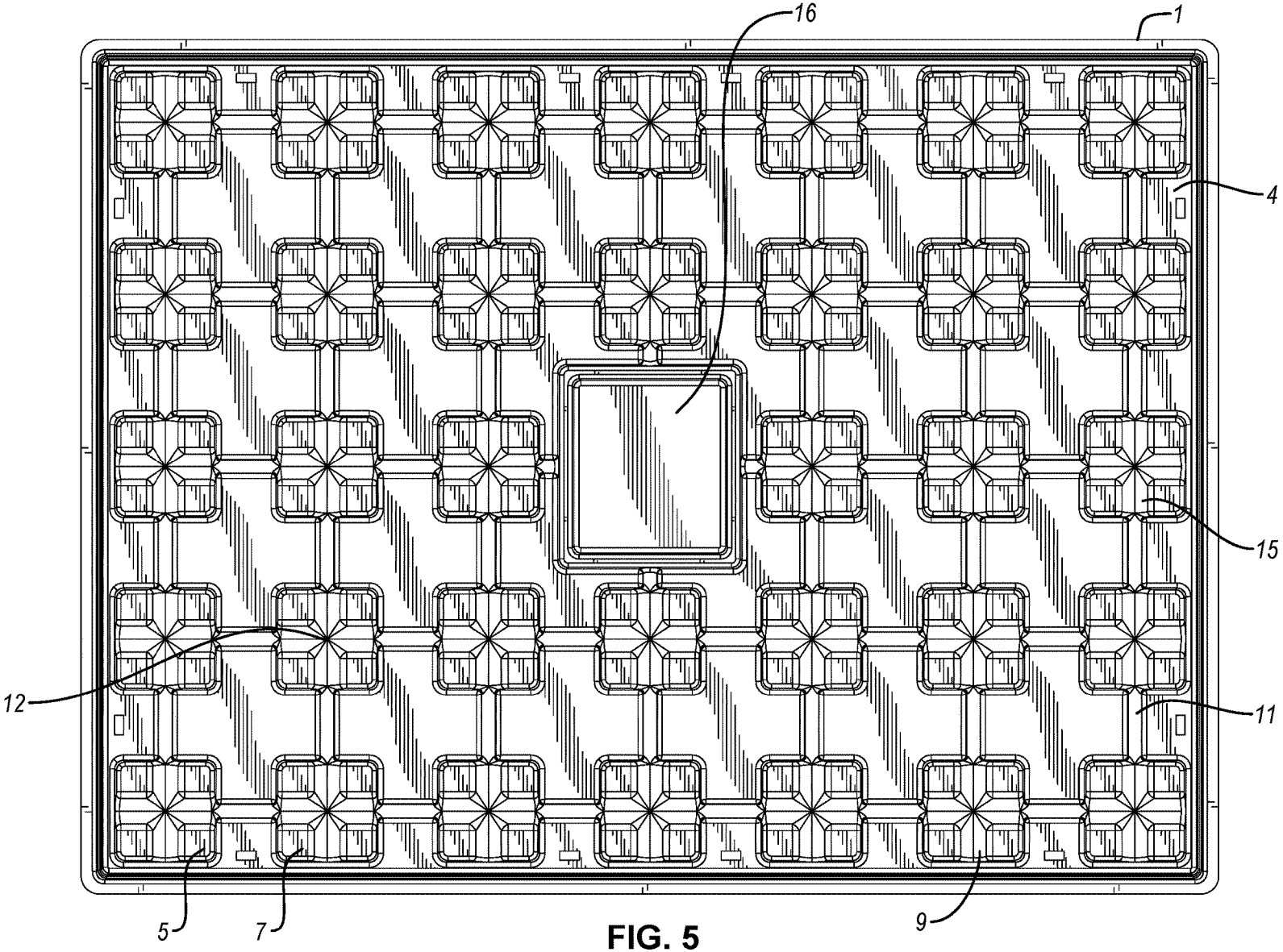
FIG. 5 is a top bird's eye view of an alternative embodiment to illustrate the plurality of coplanar drainage channels.

Now looking at FIG. 5, the bird's eye view of an alternative embodiment top portion (4) of the raised panel base (1) clearly shows the grid pattern of the depressions (15), drainage channels (11) and intersections. (12) Because the raised panel is preferably made of a single piece of material (plastic, high-density polyethylene, high-density polypropylene, rubber, polyvinyl chloride, acrylonitrile butadiene styrene (generally referred to as "ABS") or similar suitable material), looking down onto each depression (15) also shows the corresponding projection (5), secondary projections (7) and raised portions (9) for each depression (15) descending from the top. (4) Finally, the middle portion for information (16) is present in this alternative embodiment.

Another feature of the invention is its weight. Specifically, the raised panel is lighter than wooden, plastic or metal pallets, making it easier to place, easier to configure, and easier to remove. Clips or other means may be used to temporarily attach multiple raised panels together to create a raised panel surface that is larger than a single raised panel. Finally, another feature of the invention is the ability to be reused and neatly and compactly stacked when not in use. For example, in one alternative embodiment, 20 raised panels stack and fit into an eight-inch high box. The stacking function of the invention, combined with the relatively light weight of the invention, makes moving and handling of the invention very convenient.

Upon reading this disclosure, those of skill in the art will appreciate still additional alternative structural and function designs for using methods for abating moisture above and beneath a raised panel. For example, in one embodiment, the projections (5) (referred to herein sometimes as "legs") are extruded. In another embodiment, the raised panel base (1) is made by injection molding. In still further embodiments, the shape of the raised panel base as well as the shape and spacing of the projections (5) and secondary projections can vary. Of course, the raised panel base can be made in different shapes, such as triangles, squares, hexagons, diamonds, or a combination thereof, to name a few. Changing the shape of the raised panel base will necessitate changing the grid pattern of the drainage channels and intersections. For example, if the raised panel base is in the shape of a triangle, an even distribution of depressions and projections will favor drainage channels intersecting at less than right angles. Regardless of the shape of the raised panel or shape and number of projections, secondary projections, raised portions, and angels of intersection, the functionality of the raised panel base remains constant, protecting items from moisture as well as circulating air both on the top of the raised panel as well as below the raised panel.

Thus, while particular embodiments and applications have been illustrated and described, it is to be understood that the disclosed embodiments are not limited to the precise construction and components disclosed herein. Additionally, variants of additional embodiments are possible. For example, several different embodiments may include projections from the top as well as projections from the bottom. Another example includes each part being a different size and/or shape and/or material. Finally, uses of the present invention are not limited to storage units, as the invention can be used in garages, animal feed storage, agricultural uses, and other uses where items should be elevated above a floor. Therefore, the spirit and scope of the appended claims and the concepts taught herein should not be limited to the description of the preferred embodiments and embodiments contained herein.

The invention claimed is:

1. A raised panel for installation on a construction surface that can be used individually or in combination with other adjoining raised panels to cover a floor surface; said raised panel comprising:

a base comprising a moisture barrier to inhibit migration of moisture from the construction surface, said base having four sides, a top portion and a bottom portion;

a plurality of molded projections extending from said bottom corresponding with depressions descending from said top;

said projections having a coplanar lower portion edge;

said top having a plurality of generally coplanar drainage channels extending from one side to an opposing side and positioned in a general grid arrangement so that each said drainage channel extending from one side to an opposing side perpendicularly intersecting each said drainage channel extending from the remaining said two opposing sides such that each said depression is bisected by a said perpendicular drainage channel intersection.

2. The raised panel of claim 1, wherein the base is constructed from a material selected from the group consisting of plastic, high-density polyethylene, high-density polypropylene, rubber, polyvinyl chloride, and acrylonitrile butadiene styrene ("ABS").

3. The raised panel of claim 1, wherein the number of projections is thirty-five.

4. The raised panel of claim 1, wherein said panel is made of a single piece of material.

5. The raised panel of claim 1, wherein said panel is stackable with other said panels.

6. The raised panel of claim 5, wherein twenty said panels stacked measures approximately eight inches in height.

7. The raised panel of claim 1, wherein said projections have a plurality of secondary projections extending from said projections to further reduce contact with a construction floor surface while increasing points of contact with the construction floor surface.

8. The raised panel of claim 7, wherein said reduction of said contact with a construction floor surface of said secondary projections increases airflow around said projections.

9. A raised panel for installation on a construction surface that can be used individually or in combination with other adjoining raised panels to cover a floor surface; said raised panel comprising:

a base comprising a moisture barrier to inhibit migration of moisture from the construction surface, said base having four sides, a top portion and a bottom portion;

a plurality of molded projections extending from said bottom corresponding with depressions descending from said top;

said projections having a coplanar lower portion edge;

said projections have a plurality of secondary projections extending from said projections to further reduce contact with a construction floor surface while increasing points of contact with the construction floor surface;

said top having a plurality of generally coplanar drainage channels extending from one side to an opposing side and positioned in a general grid arrangement so that each said drainage channel extending from one side to an opposing side perpendicularly intersecting each said drainage channel extending from the remaining said two opposing sides such that each said depression is bisected by a said perpendicular drainage channel intersection.

* * * * *